US010962910B1

(12) United States Patent
Koyanagi et al.

(10) Patent No.: US 10,962,910 B1
(45) Date of Patent: Mar. 30, 2021

(54) HEATING MEMBER FOR FIXING DEVICE AND IMAGE FORMING APPARATUS

(71) Applicant: FUJI XEROX CO., LTD., Tokyo (JP)

(72) Inventors: Kiyoshi Koyanagi, Kanagawa (JP); Takaaki Sato, Kanagawa (JP); Toru Inoue, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/781,228

(22) Filed: Feb. 4, 2020

(30) Foreign Application Priority Data

Sep. 30, 2019 (JP) ..... JP2019-180678

(51) Int. Cl.
*G03G 15/20* (2006.01)

(52) U.S. Cl.
CPC . *G03G 15/2053* (2013.01); *G03G 2215/2035* (2013.01)

(58) Field of Classification Search
CPC ..... G03G 15/2053; G03G 2215/2016; G03G 2215/2035; H05B 3/20; H05B 3/26
USPC ..... 399/328, 329
See application file for complete search history.

(56) References Cited

U.S. PATENT DOCUMENTS

| | | | | |
|---|---|---|---|---|
| 6,049,064 | A * | 4/2000 | Natsuhara | G03G 15/2064 219/216 |
| 9,405,243 | B2 | 8/2016 | Ogura | |
| 10,303,097 | B2 | 5/2019 | Nakashima et al. | |
| 2014/0186078 | A1* | 7/2014 | Imaizumi | G03G 15/2057 399/329 |
| 2015/0139708 | A1* | 5/2015 | Shimura | G03G 15/2042 399/329 |
| 2018/0181037 | A1* | 6/2018 | Kataoka | G03G 15/2053 |
| 2019/0235425 | A1* | 8/2019 | Sato | G03G 15/2053 |

FOREIGN PATENT DOCUMENTS

| | | | |
|---|---|---|---|
| JP | 6-314036 | A | 11/1994 |
| JP | 2014-102429 | A | 6/2014 |
| JP | 2016-001300 | A | 1/2016 |
| JP | 2017142425 | A * | 8/2017 |

* cited by examiner

*Primary Examiner* — Robert B Beatty
(74) *Attorney, Agent, or Firm* — Sughrue Mion, PLLC

(57) ABSTRACT

A fixing device includes a heat source, a support portion, at least one adhesive layer, and a heat transfer member. The support portion supports the heat source. The at least one adhesive layer fixes the heat source and the support portion to each other. The heat transfer member is disposed at a portion other than a portion between the adhesive layer and the heat source to conduct heat of a portion of the heat source to another portion of the heat source.

15 Claims, 10 Drawing Sheets

HEATING MEMBER FOR FIXING DEVICE AND IMAGE FORMING APPARATUS

CROSS-REFERENCE TO RELATED APPLICATIONS

This application is based on and claims priority under 35 USC 119 from Japanese Patent Application No. 2019-180678 filed Sep. 30, 2019.

BACKGROUND

(i) Technical Field

The present disclosure relates to a fixing device and an image forming apparatus.

(ii) Related Art

Japanese Unexamined Patent Application Publication No. 2016-1300 discloses a structure where a heater and a heater support member are bonded together with an adhesive at least one portion, serving as a bonding portion, in the longitudinal direction between a side surface of the heater in the longitudinal direction and an inner wall surface of the heater support member.

Japanese Unexamined Patent Application Publication No. 2014-102429 discloses a heating device including a ceramic heater, a graphite sheet, which is a plane anisotropic heat conduction member in contact with the ceramic heater, and a temperature sensor that measures the temperature of the ceramic heater.

Japanese Unexamined Patent Application Publication No. 06-314036 discloses a heating device that provides heat of a heating member to a transfer medium by bringing a heat-resistant film into pressure contact with the heating member with a pressing member to cause the heat-resistant film to travel, and by holding the transfer medium at a nip between the heat-resistant film and the pressing member to cause the transfer medium and the heat-resistant film to travel together.

SUMMARY

Fixing devices usually include a heat source. The heat source is preferably fixed to a support portion that supports the heat source. Many fixing devices also include a heat transfer member that conducts part of heat of the heat source to another portion of the heat source.

A conceivable aspect of fixing the heat source is to bond the heat source and the support portion together via the heat transfer member bonded to the support portion. In this aspect, movement of the heat transfer member is restricted by the adhesive, whereas the heat source starts thermal expansion. In this case, fixing between the heat transfer member and the heat source is hindered, and fixing of the heat source to the support portion is hindered.

Aspects of non-limiting embodiments of the present disclosure relate to enabling fixing of a heat source to a support portion while a heat transfer member that conducts part of heat of the heat source to another portion is installed.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a fixing device including a heat source, a support portion that supports the heat source, at least one adhesive layer that fixes the heat source and the support portion to each other, and a heat transfer member disposed at a portion other than a portion between the adhesive layer and the heat source to conduct heat of a portion of the heat source to another portion of the heat source.

BRIEF DESCRIPTION OF THE DRAWINGS

Exemplary embodiments of the present disclosure will be described in detail based on the following figures, wherein.

DETAILED DESCRIPTION

With reference to the attached drawings, exemplary embodiments of the present disclosure will be described, below.

Figure 1:
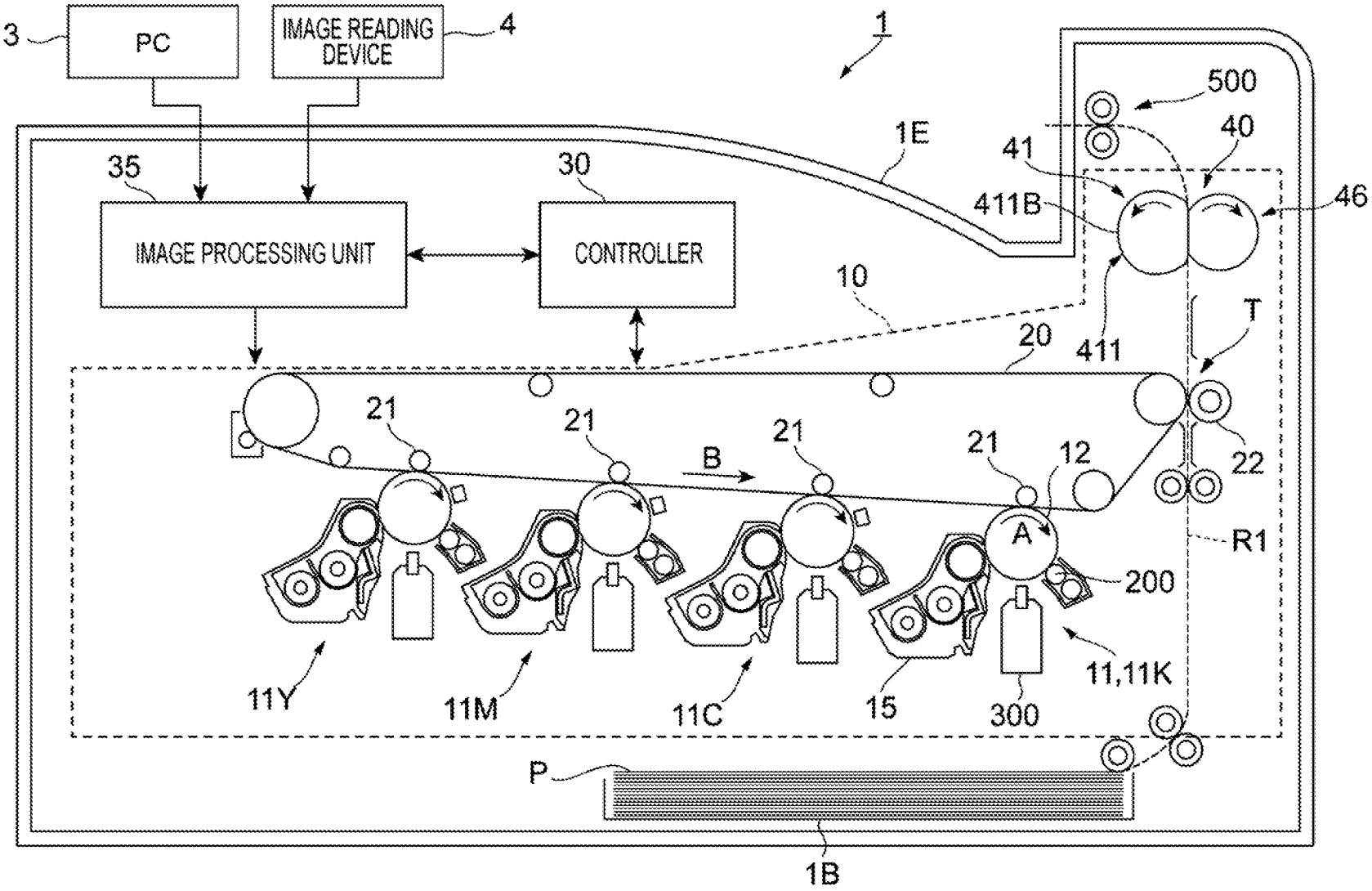
FIG. 1 illustrates an entire structure of an image forming apparatus.

FIG. 1 illustrates the entire structure of an image forming apparatus 1. More specifically, FIG. 1 illustrates the image forming apparatus 1 when viewed from the front (front surface).

The image forming apparatus 1 is a so-called tandem color printer.

The image forming apparatus 1 includes an image forming portion 10, which is an example of an image forming device. The image forming portion 10 forms images on sheets P, which is an example of recording media, on the basis of image data for respective colors.

The image forming apparatus 1 includes a controller 30 and an image processing unit 35.

The controller 30 controls function portions of the image forming apparatus 1.

The image processing unit 35 performs image processing on image data from, for example, a personal computer (PC) 3 or an image reading device 4.

The image forming portion 10 includes four image forming units 11Y, 11M, 11C, and 11K (hereinafter also collectively referred to as "image forming units 11", simply) arranged side by side at regular intervals.

Image forming units 11 have the same structure except for toner accommodated in development devices 15 (described later). The image forming units 11 form toner images (images) of yellow (Y), magenta (M), cyan (C), and black (K), respectively.

Each of the image forming units 11 includes a photoconductor drum 12, a charging device 200, which electrically charges the photoconductor drum 12, and an LED print head (LPH) 300, which exposes the photoconductor drum 12 to light.

The photoconductor drum 12 is electrically charged by the charging device 200. The photoconductor drum 12 is also exposed to light by the LPH 300 to have an electrostatic latent image formed thereon.

Each image forming unit 11 also includes a development device 15, which develops an electrostatic latent image formed on the photoconductor drum 12, and a cleaner (not illustrated) that cleans the surface of the photoconductor drum 12.

The image forming portion 10 also includes an intermediate transfer belt 20, to which toner images of different colors formed on the respective photoconductor drums 12 are transferred, and first transfer rollers 21, which sequentially transfer (first-transfer) the toner images of the different colors formed on the photoconductor drums 12 to the intermediate transfer belt 20.

The image forming portion 10 also includes a second transfer roller 22, which collectively transfers (second-transfers) the toner images transferred to the intermediate transfer belt 20 to a sheet P, and a fixing device 40, which fixes the toner images transferred to the sheet P onto the sheet P.

The fixing device 40 includes a fixing belt module 41 including a heat source, and a pressing roller 46.

The fixing belt module 41 is disposed on the left of a sheet transport path R1 in FIG. 1. The pressing roller 46 is disposed on the right of the sheet transport path R1 in FIG. 1. The pressing roller 46 is pressed against the fixing belt module 41.

The fixing belt module 41 includes a film-shaped fixing belt 411 that touches the sheet P.

The fixing belt 411, serving as an example of a belt member, includes, for example, a release layer that is located at the outermost layer to touch the sheet P, an elastic layer that is located on the inner side of the release layer, and a base layer that supports the elastic layer. The fixing belt 411 is endless and circularly moves in a counterclockwise direction in FIG. 1.

The fixing belt 411 touches the sheet P transported from below in FIG. 1. The portion of the fixing belt 411 that touches the sheet P moves together with the sheet P. The fixing belt 411 then holds the sheet P together with the pressing roller 46 to press and heat the sheet P.

The fixing belt module 41 includes a heat source (described later) that heats the fixing belt 411 on the inner side of the fixing belt 411.

The pressing roller 46, which is an example of a pressing member, is disposed on the right of the sheet transport path R1 in FIG. 1. The pressing roller 46 is pressed against an outer circumferential surface 411B of the fixing belt 411 to press the sheet P passing between the fixing belt 411 and the pressing roller 46 (sheet P passing along the sheet transport path R1).

The pressing roller 46 is rotated by a motor (not illustrated) in the clockwise direction in FIG. 1. When the pressing roller 46 rotates in the clockwise direction, the fixing belt 411 rotates in the counterclockwise direction upon receipt of a driving force from the pressing roller 46.

In the image forming apparatus 1, the image processing unit 35 performs image processing on image data from the PC 3 or the image reading device 4, and the image data subjected to image processing is fed to the image forming units 11.

For example, in the image forming unit 11K for black (K), the photoconductor drum 12 is electrically charged by the charging device 200 while rotating in the direction of arrow A, and exposed to light by the LPH 300 that radiates light based on the image data transmitted from the image processing unit 35.

Thus, the image forming unit 11K forms an electrostatic latent image for a black (K) image on the photoconductor drum 12. The electrostatic latent image formed on the photoconductor drum 12 is developed by the development device 15 and formed into a toner image for black (K) on the photoconductor drum 12.

Similarly, the image forming units 11Y, 11M, and 11C respectively form toner images for yellow (Y), magenta (M), and cyan (C).

The toner images of different colors formed by the image forming units 11 are sequentially electrostatically attracted to the intermediate transfer belt 20 moving in the direction of arrow B by the first transfer rollers 21. Thus, the toner images obtained by superposing the different color toner are formed on the intermediate transfer belt 20.

The toner images formed on the intermediate transfer belt 20 are transported to a portion where the second transfer roller 22 is located (second transfer portion T) in accordance with the movement of the intermediate transfer belt 20. Then, at the timing where the toner images are transported to the second transfer portion T, a sheet P is fed from a sheet containing unit 1B to the second transfer portion T.

At the second transfer portion T, the transfer electric field formed by the second transfer roller 22 collectively electrostatically transfers the toner images on the intermediate transfer belt 20 to a sheet P transported to the second transfer portion T.

Thereafter, the sheet P to which the toner images are electrostatically transferred is separated from the intermediate transfer belt 20, and transported to the fixing device 40.

In the fixing device 40, the sheet P is held between the fixing belt module 41 and the pressing roller 46.

Specifically, the sheet P is held between the fixing belt 411 that circularly moves in the counterclockwise direction and the pressing roller 46 that rotates in the clockwise direction.

Thus, the sheet P is pressed and heated to have the toner images on the sheet P fixed to the sheet P. The sheet P that has undergone fixing is transported to a sheet receiving portion 1E by discharging rollers 500.

Figure 2A:
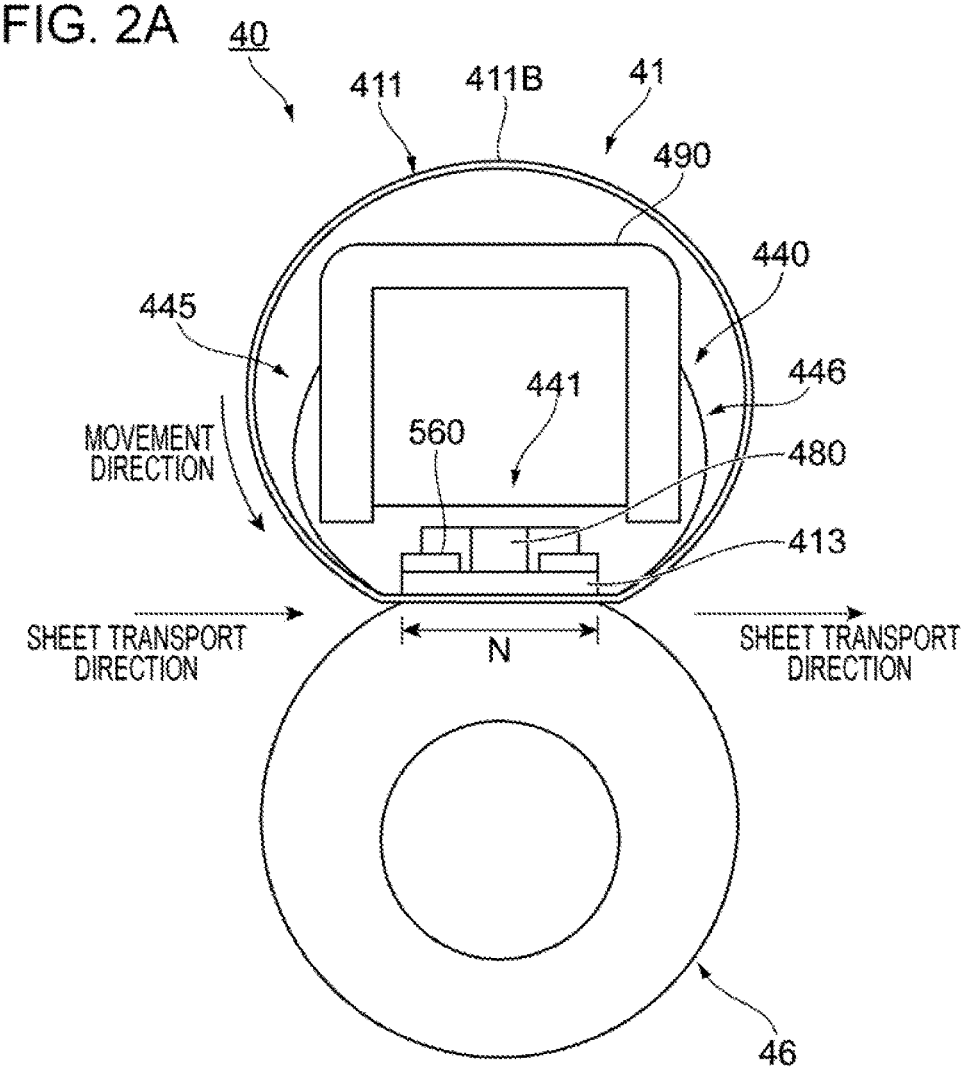
FIGS. 2A and 2B illustrate the structure of a fixing device.
Figure 2B:
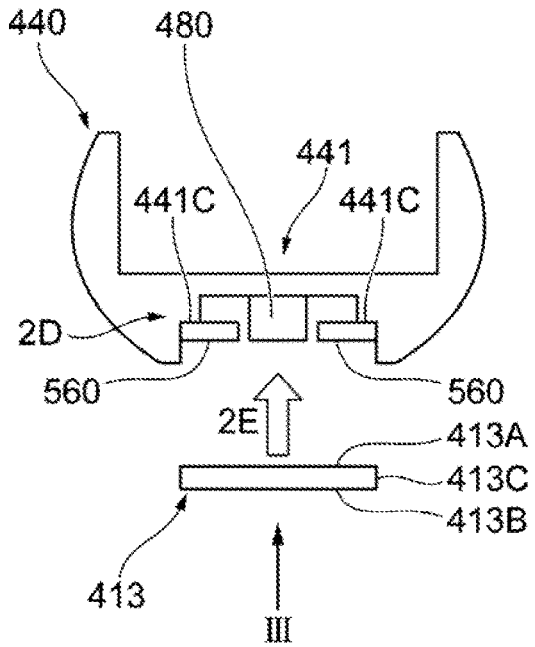

FIGS. 2A and 2B illustrate the structure of the fixing device 40.

As illustrated in FIG. 2A, the fixing device 40 includes a fixing belt module 41 and a pressing roller 46.

The fixing belt module 41 includes a fixing belt 411, used for fixing the toner image to the sheet P. The fixing belt 411 is pressed against the surface of the sheet P on which the toner images are formed.

The pressing roller 46, which is an example of the pressing member, is pressed against the outer circumferential surface 411B of the fixing belt 411 to press the sheet P passing between the fixing belt 411 and the pressing roller 46.

Specifically, the pressing roller 46 is disposed in contact with the outer circumferential surface 411B of the fixing belt 411, and forms a nip N, which is an area where the sheet P passes while being pressed, between itself and the fixing belt 411.

In the present exemplary embodiment, the sheet P is heated and pressed while passing the nip N, so that the toner image is fixed to the sheet P.

A heat source 413, which heats the fixing belt 411, is disposed on the inner side of the fixing belt 411.

A support member 440, which supports the heat source 413, is also disposed on the inner side of the fixing belt 411. The support member 440 includes a support portion 441, which supports the heat source 413.

The heat source 413 has a plate shape, and is disposed parallel to the direction in which the fixing belt 411 moves and the width direction of the fixing belt 411.

More specifically, the heat source 413 has a rectangular shape when viewed from the front, and is disposed to have its longitudinal direction coinciding with the width direction of the fixing belt 411. Here, the width direction of the fixing belt 411 is synonymous with the direction orthogonal to the movement direction of the fixing belt 411.

In the present exemplary embodiment, the fixing belt 411 is heated with heat fed from the heat source 413 to the fixing belt 411.

As illustrated in FIG. 2B, the heat source 413 has an opposing surface 413A, which faces the support portion 441, a back surface 413B, which is located opposite to the opposing surface 413A, and side surfaces 413C, which connect the opposing surface 413A and the back surface 413B to each other.

In the present exemplary embodiment, as illustrated in FIG. 2A, the pressing roller 46 is pressed against the heat source 413 with the fixing belt 411 interposed therebetween.

As illustrated in FIG. 2A, the support member 440 includes an upstream guide portion 445 and a downstream guide portion 446.

In the rotation direction (movement direction) of the fixing belt 411, the upstream guide portion 445 is located upstream of the heat source 413. The upstream guide portion 445 touches a portion of the fixing belt 411 located upstream of the heat source 413 to guide this upstream portion.

The downstream guide portion 446 is located downstream of the heat source 413 in the rotation direction of the fixing belt 411.

The downstream guide portion 446 touches a portion of the fixing belt 411 located downstream of the heat source 413 to guide the downstream portion.

The fixing belt module 41 also includes a support frame 490, which is an internal member. The support frame 490 is disposed on the inner side of the fixing belt 411 to support the members disposed on the inner side of the fixing belt 411.

Specifically, the support frame 490 supports components such as the support member 440 and the heat source 413 disposed on the inner side of the fixing belt 411.

As illustrated in FIG. 2A, in the present exemplary embodiment, adhesive layers 480, which fix the heat source 413 and the support portion 441, are disposed. In the present exemplary embodiment, the adhesive layers 480 fix the heat source 413 and the support portion 441 to each other.

The present exemplary embodiment also includes a heat transfer member 560, which is disposed in contact with the heat source 413 to conduct part of heat of the heat source 413 to another portion of the heat source 413.

The heat transfer member 560 is formed from a metal material such as aluminum or copper and a graphite sheet.

In the fixing device 40, the temperature at the end portions of the heat source 413 in the longitudinal direction sometimes exceeds the temperature at the center portion of the heat source 413 in the longitudinal direction. Thus, the heat transfer member 560 feeds the heat from the end portions to the center portion to uniformize the temperature of the heat source 413.

More specifically, in the fixing device 40, when, for example, sheets P having a small width are successively transported, heat at the center portion of the heat source 413 in the longitudinal direction may be lost, and the end portions of the heat source 413 in the longitudinal direction may have a temperature higher than the temperature at the center portion of the heat source 413 in the longitudinal direction.

The heat transfer member 560 feeds heat at the end portions to the center portion to uniformize the temperature of the heat source 413. In other words, the heat transfer member 560 reduces the temperature variation of the heat source 413.

The heat transfer member 560 is disposed on the heat source 413 on the surface on which the adhesive layers 480 are disposed. More specifically, the plate-shaped heat source 413 has a surface on which the adhesive layers 480 are disposed and a surface opposite to the surface on which the adhesive layers 480 are disposed. The heat transfer member 560 is disposed on the surface of the plate-shaped heat source 413 on which the adhesive layers 480 are disposed.

In the present exemplary embodiment, the heat transfer member 560 is disposed at a portion other than the portion between the adhesive layers 480 and the heat source 413. More specifically, the heat transfer member 560 is disposed at a portion different from the portions between the adhesive layers 480 and the heat source 413.

In the present exemplary embodiment, grease, an adhesive, or a double-sided tape is disposed between the heat transfer member 560 and the heat source 413. This structure facilitates heat transfer from the heat source 413 to the heat transfer member 560, and from the heat transfer member 560 to the heat source 413. In addition, the heat transfer member 560 is prevented from moving toward the heat source 413.

As illustrated in FIG. 2B, the support portion 441 includes end-receiving portions 441C, against which both end portions of the heat transfer member 560 in the lateral direction are pressed. The end-receiving portions 441C fix the position of the heat transfer member 560 in the thickness direction.

FIG. 2B illustrates the procedure of assembling the fixing device 40.

In the present exemplary embodiment, as denoted with reference sign 2D, firstly, the heat transfer member 560 is pressed against the support member 440, and an adhesive is applied to the support portion 441.

Thereafter, as denoted with arrow 2E, the heat source 413 is pressed against the heat transfer member 560 to install the heat source 413. When the heat source 413 is installed, the heat source 413 is pressed against the heat transfer member 560, and then the heat transfer member 560 is pressed against the end-receiving portions 441C.

Thereafter, an adhesive located between the support portion 441 and the heat source 413 cures to form the adhesive layers 480, so that the support portion 441 and the heat source 413 are fixed to each other.

Figure 3:
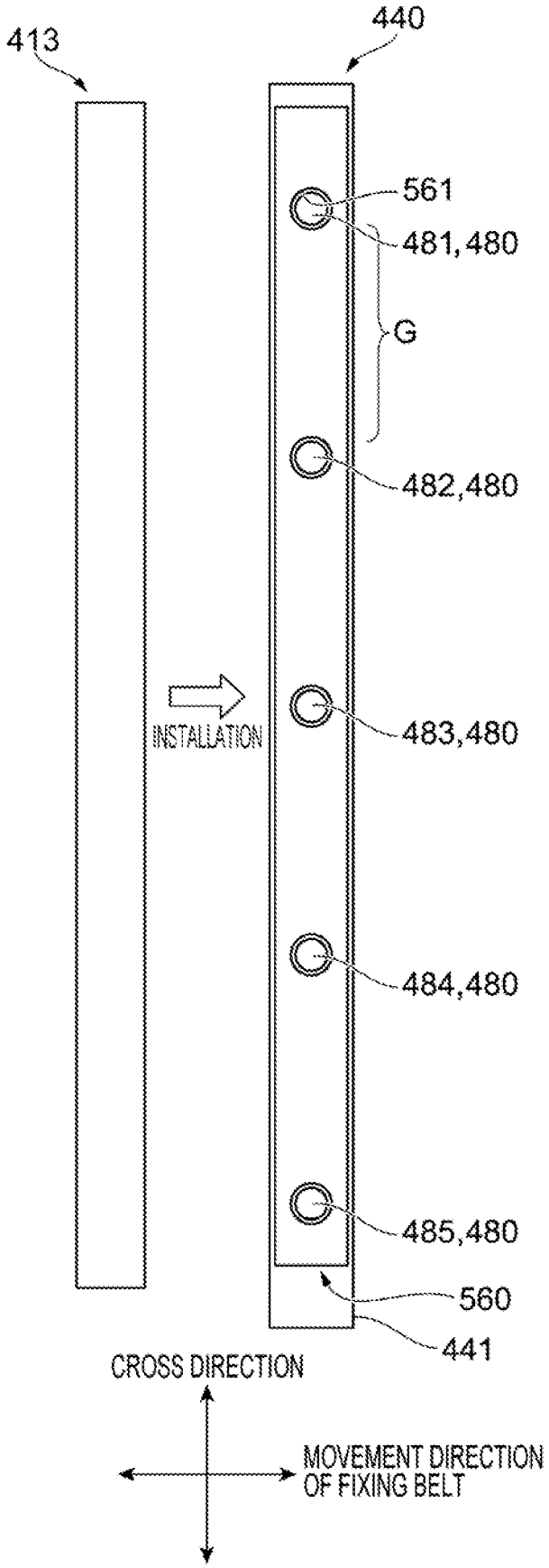
FIG. 3 illustrates components including a heat transfer member and an adhesive layer when viewed in the direction of arrow III in FIG. 2B.

FIG. 3 illustrates components including the heat transfer member 560 and the adhesive layers 480 when viewed in the direction of arrow III in FIG. 2B.

In the present exemplary embodiment, the heat transfer member 560 is disposed to extend in the direction crossing (orthogonal to) the movement direction of the fixing belt 411. More specifically, the heat transfer member 560 is disposed to extend in the width direction of the fixing belt 411.

More specifically, the heat transfer member 560 has a rectangular shape when viewed from the front, and is disposed to have its longitudinal direction coinciding with the width direction of the fixing belt 411.

The heat transfer member 560 has multiple circular through-holes 561. These through-holes 561 are disposed so that the heat transfer member 560 and the heat source 413 are shifted in locations in the longitudinal direction. In the present exemplary embodiment, the circular through-holes 561 are illustrated by way of example, but the through-holes 561 may have any of other shapes such as a polygonal or oval shape.

The through-holes 561 are arranged in the longitudinal direction of the heat transfer member 560 and the heat source 413. More specifically, the through-holes 561 are arranged linearly and unidirectionally.

In the present exemplary embodiment, the adhesive layers 480 are disposed in the through-holes 561, and the adhesive layers 480 in the through-holes 561 fix the heat source 413 and the support portion 441 together.

In the present exemplary embodiment, five adhesive layers 480, that is, a first adhesive layer 481 to a fifth adhesive layer 485, are disposed as examples of the adhesive layers 480.

In the present exemplary embodiment, the first adhesive layer 481 to the fifth adhesive layer 485 are arranged in order from the first adhesive layer 481, the second adhesive layer 482, the third adhesive layer 483, the fourth adhesive layer 484, and the fifth adhesive layer 485.

In the present exemplary embodiment, a gap G is disposed between two of the adhesive layers 480 adjacent to each other, so that four gaps G are disposed in total. These four gaps G have the same size.

In the present exemplary embodiment, the third adhesive layer 483 is located at the center portion of the heat source 413 in the longitudinal direction, and the other adhesive layers 480 are allocated to the right and left with the center portion of the heat source 413 in the longitudinal direction at the center.

Figure 4A:
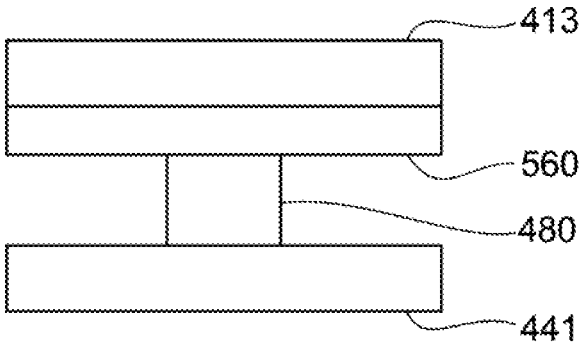
FIGS. 4A and 4B illustrate a comparative example of a fixing device at a portion where a support portion, a heat source, an adhesive layer, and a heat transfer member are installed.
Figure 4B:
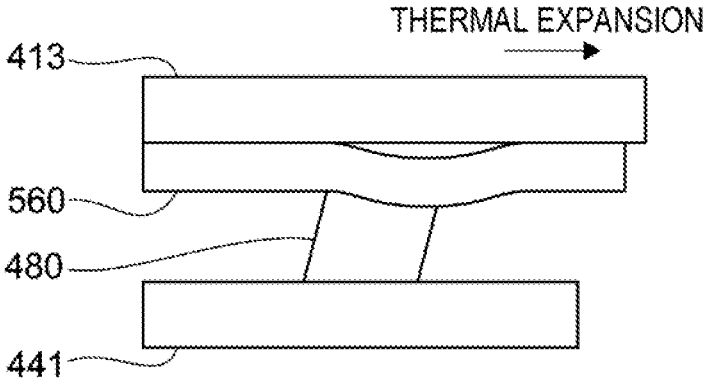

FIGS. 4A and 4B illustrate a comparative example of the fixing device 40 at a portion that includes the support portion 441, the heat source 413, the adhesive layer 480, and the heat transfer member 560.

In this comparative example, as illustrated in FIG. 4A, the heat transfer member 560 is disposed between the adhesive layer 480 and the heat source 413. In this comparative example, the support portion 441 and the heat source 413 are fixed together with the heat transfer member 560 interposed therebetween. In this comparative example, the heat source 413 and the heat transfer member 560 are bonded together.

Here, in this comparative example, the heat source 413 bonded to the heat transfer member 560 is easily detachable from the heat transfer member 560, so that the support of the heat source 413 is more likely to become unstable.

More specifically, in this comparative example, as illustrated in FIG. 4B, the heat source 413 expands due to thermal expansion, whereas movement of the heat transfer member 560 is restricted by the adhesive layer 480. Thus, the heat source 413 is easily detachable from the heat transfer member 560, and the support of the heat source 413 is more likely to become unstable.

Comparatively, in the present exemplary embodiment, as illustrated in FIGS. 2A and 2B, the adhesive layer 480 directly fixes the heat source 413 and the support portion 441 to each other. More specifically, in the present exemplary embodiment, the adhesive layer 480 does not touch the heat transfer member 560.

Thus, in the present exemplary embodiment, the heat source 413 is more stably fixed to the support portion 441 compared to the comparative example where the heat source 413 is fixed to the support portion 441 with the heat transfer member 560 interposed therebetween.

In another conceivable aspect of the embodiment, the heat transfer member 560 and the heat source 413 are pressed against the support portion 441 to fix the heat transfer member 560 and the heat source 413 to the support portion 441 without providing the adhesive layer 480 and by using the pressure exerted on the heat source 413 from the pressing roller 46.

In this aspect, as long as the pressing roller 46 is pressed against the heat source 413, the heat transfer member 560 and the heat source 413 are stably fixable to the support portion 441.

However, in this aspect, components such as the heat source 413 and the heat transfer member 560 are more likely to cause misregistration when the pressing roller 46 withdraws from the heat source 413.

More specifically, the fixing device 40 may have a function of withdrawing the pressing roller 46. When the pressing roller 46 withdraws, the pressure exerted on the heat source 413 decreases, and components such as the heat source 413 and the heat transfer member 560 are more likely to cause misregistration.

When components such as the heat source 413 and the heat transfer member 560 cause misregistration, the pressing roller 46 that subsequently proceeds toward the heat source 413 may be left misregistered, which may cause breakage of components or reduction in fixing performance.

In the structure of the present exemplary embodiment, comparatively, the heat source 413 and the heat transfer member 560 are less likely to cause misregistration even after the pressing roller 46 withdraws, so that breakage of components or reduction in fixing performance is less likely to occur.

Preferably, the adhesive layer 480 has a thickness of greater than or equal to 0.1 mm.

Figure 5A:
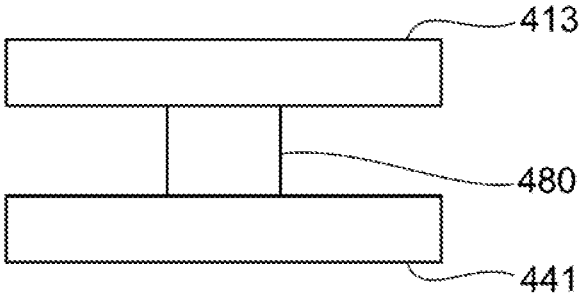
FIGS. 5A and 5B illustrate the adhesive layer in the state where the heat source has caused thermal expansion.
Figure 5B:
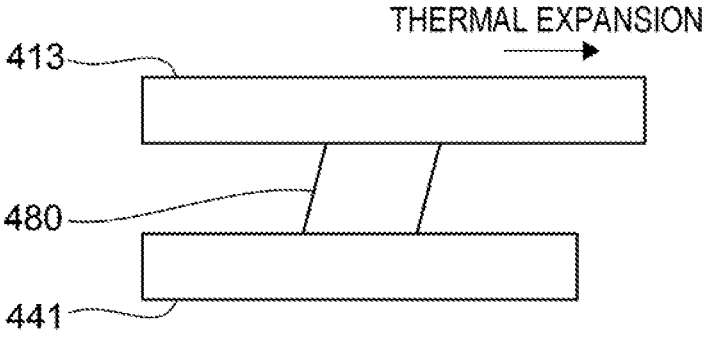

When the adhesive layer 480 has a thickness of greater than or equal to 0.1 mm, the adhesive layer 480 is more likely to be deformed following the heat source 413 even when the heat source 413 causes thermal expansion as illustrated in FIGS. 5A and 5B (illustrating the state of the adhesive layer 480 where the heat source 413 causes thermal expansion).

More specifically, when the heat source 413 is turned on, the heat source 413 expands in the longitudinal direction. Here, when the adhesive layer 480 has a thickness of smaller than 0.1 mm, the adhesive layer 480 is less likely to follow the heat source 413 when the heat source 413 expands in the longitudinal direction, and thus the adhesive layer 480 is more likely to be detachable from the heat source 413.

Comparatively, when the adhesive layer 480 has a thickness of greater than or equal to 0.1 mm, the adhesive layer 480 is more likely to follow the heat source 413, and is thus less likely to be detachable from the heat source 413.

Figure 6:
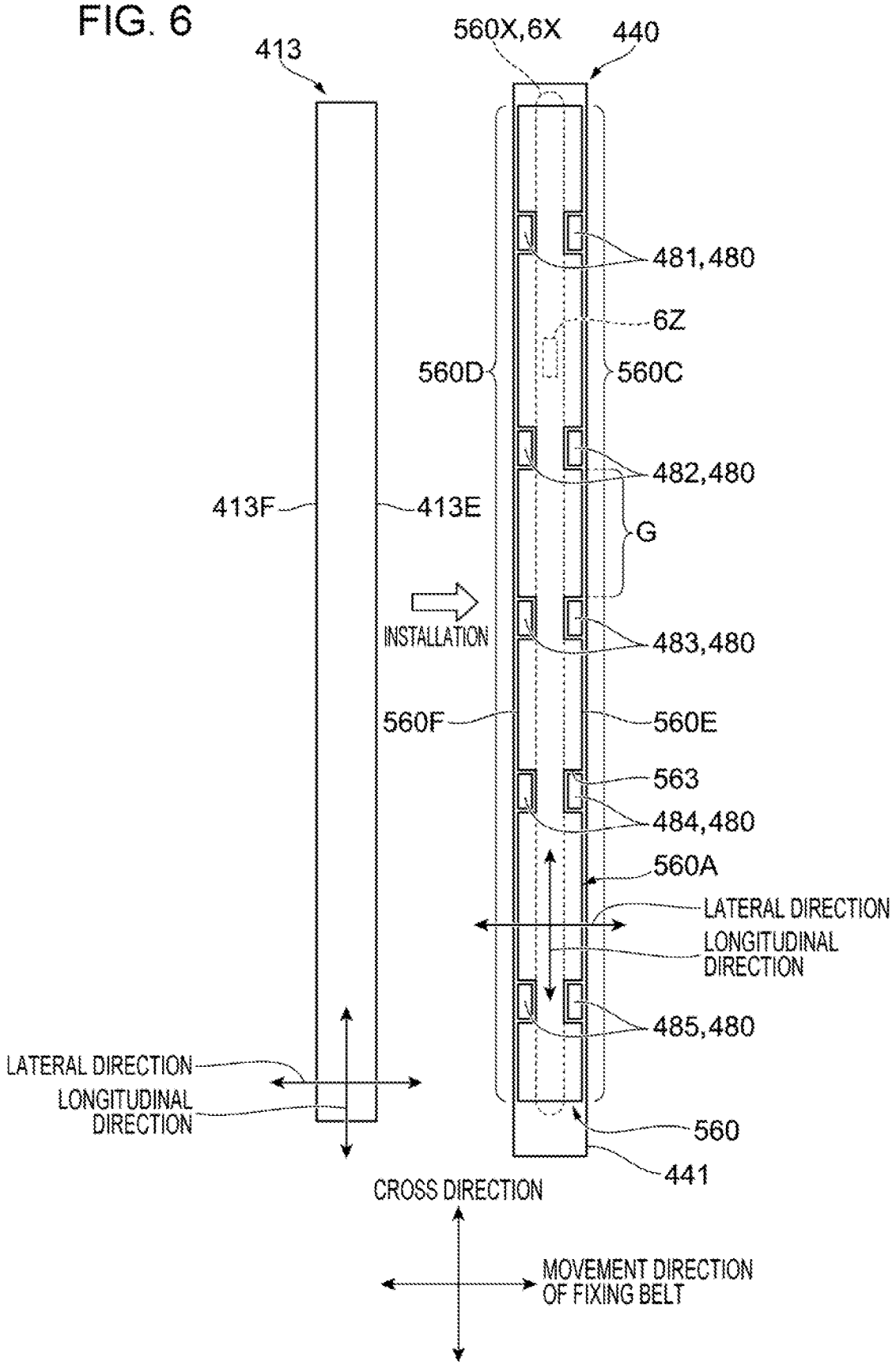
FIG. 6 illustrates another structure example of the fixing device.

FIG. 6 illustrates another structure example of the fixing device 40. FIG. 6 illustrates the heat source 413 immediately before being installed on the support portion 441.

In this structure example, as in the above case, the heat transfer member 560 is disposed on the surface of the heat source 413 on which the adhesive layers 480 are disposed.

In this structure example, the heat transfer member 560 has indentations 563 at an outer peripheral edge 560A. In this structure example, the adhesive layers 480 are disposed in the indentations 563, and the adhesive layers 480 in the indentations 563 fix the heat source 413 and the support portion 441 to each other. In the present exemplary embodiment, the indentations 563 have a rectangular cross section, but may have a cross section of any other shape such as semi-circular or triangular shape, instead of rectangular.

This structure example includes multiple indentations 563.

These multiple indentations 563 are located so that the heat transfer member 560 and the heat source 413 are shifted in locations in the longitudinal direction.

The heat transfer member 560 includes a first long side 560C and a second long side 560D. The indentations 563 are disposed on both the first long side 560C and the second long side 560D.

With respect to the position of the heat transfer member 560 in longitudinal direction, the positions of the indentations 563 on the first long side 560C coincide with the positions of the indentations 563 on the second long side 560D.

In this structure example, the heat source 413 extends unidirectionally, and has ends in the lateral direction fixed to the support portion 441 with the adhesive layers 480.

More specifically, the heat source 413 includes a first end portion 413E and a second end portion 413F, which are located at different positions in the lateral direction. In the present exemplary embodiment, the first end portion 413E and the second end portion 413F of the heat source 413 are fixed to the support portion 441 with the adhesive layers 480.

In this structure example, the five adhesive layers 480, that is, the first adhesive layer 481 to the fifth adhesive layer 485 are disposed at positions opposing each of the first end portion 413E and the second end portion 413F in the lateral direction of the heat source 413.

The first adhesive layer 481 to the fifth adhesive layer 485 are arranged in order from the first adhesive layer 481, the second adhesive layer 482, the third adhesive layer 483, the fourth adhesive layer 484, and the fifth adhesive layer 485.

In the present exemplary embodiment, a gap G is disposed between each two of the adhesive layers 480, forming the first adhesive layer 481 to the fifth adhesive layer 485. Four gaps G are disposed in total in the area where the first adhesive layer 481 to the fifth adhesive layer 485 are disposed. In the present exemplary embodiment, these four gaps G have the same size.

In the present exemplary embodiment, the third adhesive layer 483 is located at the center portion of the heat source 413 in the longitudinal direction, and the first adhesive layer 481 to the fifth adhesive layer 485 are allocated to the left and right (up and down in the drawing) with respect to the center portion of the heat source 413 in the longitudinal direction at the center.

In this structure example, the through-holes 561 and the indentations 563 are not disposed at portions of the heat transfer member 560 located at the center portion in the lateral direction.

More specifically, in this structure example, the indentations 563 are disposed at a first end portion 560E and a second end portion 560F in the lateral direction of the heat transfer member 560. However, neither through-holes nor indentations are disposed at portions of the heat transfer member 560 located at the center portion in the lateral direction.

More specifically, neither through-holes nor indentations are disposed at portions of the heat transfer member 560 located in an area 560X denoted with reference sign 6X.

More specifically, neither through-holes nor indentations are disposed in the belt-shaped area 560X of the heat transfer member 560 extending in the longitudinal direction of the heat transfer member 560 and located at the center portion in the lateral direction of the heat transfer member 560.

It is conceivable, as illustrated in FIG. 6, that the fixing device 40 includes a temperature sensor 6Z disposed behind the heat transfer member 560 (disposed so as to hold the heat transfer member 560 and on the surface away from the heat source 413).

As in the present exemplary embodiment, in the structure where neither through-holes 561 nor indentations 563 are disposed in the belt-shaped area 560X located at the center portion in the lateral direction of the heat transfer member 560, installation of the temperature sensor 6Z is facilitated.

Figure 7:
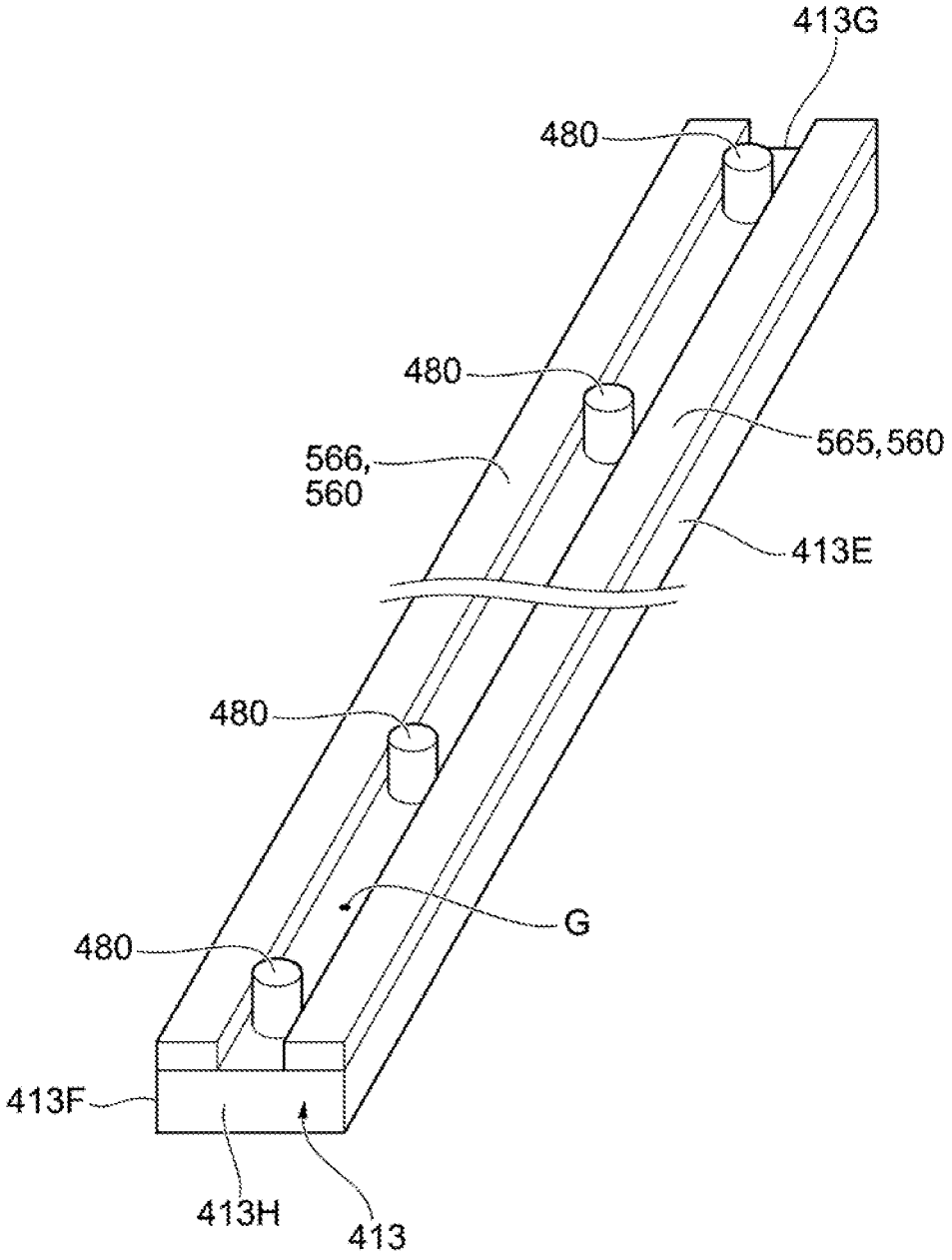
FIG. 7 illustrates another structure example of the fixing device.

FIG. 7 illustrates another structure example of the fixing device 40. FIG. 7 is a perspective view of a portion of the fixing device 40 where the heat source 413, the adhesive layers 480, and the heat transfer member 560 are disposed when viewed from the support portion 441. FIG. 7 does not illustrate the support portion 441.

This structure example includes multiple adhesive layers 480, and these adhesive layers 480 are arranged in the longitudinal direction of the heat source 413.

More specifically, multiple adhesive layers 480 are arranged unidirectionally. In this structure example, as in the above case, a gap G is disposed between each two adhesive layers 480 adjacent to each other.

This structure example includes, as the heat transfer members 560, a first heat transfer member 565 and a second heat transfer member 566.

The first heat transfer member 565 and the second heat transfer member 566 are disposed on the surface of the heat source 413 where the adhesive layers 480 are disposed. The first heat transfer member 565 and the second heat transfer member 566 extend from a first end portion 413G toward a second end portion 413H in the longitudinal direction of the heat source 413.

The first heat transfer member 565 and the second heat transfer member 566 extend from the first end portion 413G toward the second end portion 413H through a portion other than the portion where the adhesive layers 480 are disposed.

More specifically, the first heat transfer member 565 and the second heat transfer member 566 extend to the second end portion 413F beside the adhesive layers 480.

In this structure example, the first heat transfer member 565 is disposed on the first end portion 413E in the lateral direction of the heat source 413, and the second heat transfer member 566 is disposed on the second end portion 413F in the lateral direction of the heat source 413.

In this structure example, the adhesive layers 480 are disposed between the first heat transfer member 565 and the second heat transfer member 566.

Thus far, the structure example including the through-holes 561 and the indentations 563 has been described by way of example. However, the through-holes 561 and the indentations 563 may be omitted. As illustrated in FIG. 7, flat plate-shaped heat transfer members 560 including neither through-holes 561 nor indentations 563 may be disposed parallel to the longitudinal direction of the heat source 413.

In the present exemplary embodiment, two heat transfer members 560, that is, the first heat transfer member 565 and the second heat transfer member 566, are disposed. However, the structure may include only one heat transfer member 560, that is, either one of the first heat transfer member 565 and the second heat transfer member 566.

Figure 8:
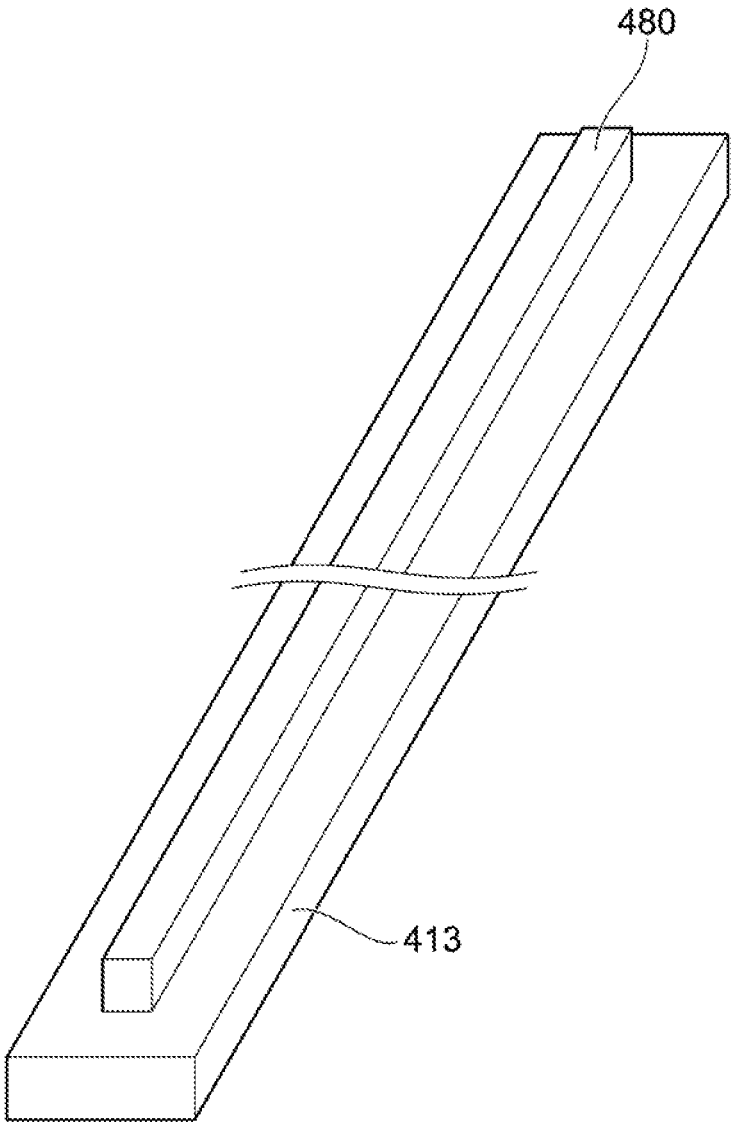
FIG. 8 illustrates another structure example of the fixing device.

FIG. 8 illustrates another structure example of the fixing device 40. FIG. 8 illustrates neither the support portion 441 nor the heat transfer member 560.

In the above description, a case where the multiple adhesive layers 480 are arranged with a gap G interposed between each two of the adhesive layers 480 has been described.

However, as illustrated in FIG. 8, for example, the adhesive layer 480 may be disposed to extend in the longitudinal direction of the heat source 413. More specifically, the adhesive layer 480 may be continuously disposed in the longitudinal direction of the heat source 413.

However, as in the case illustrated in FIG. 7, the case where the multiple adhesive layers 480 are arranged with a gap G between each two of the adhesive layers 480 is more effective in reducing the extension amount of the adhesive layers 480 than in the case where the adhesive layer 480 is continuously disposed.

More specifically, the case where the multiple adhesive layers 480 are arranged with a gap G between each two of the adhesive layers 480 is more effective in reducing the extension amount of the adhesive layers 480 when the adhesive layers 480 are extended in accordance with thermal expansion of the heat source 413 than in the case where the adhesive layer 480 is continuously disposed.

Here, when the adhesive layer 480 is continuously disposed, the adhesive layer 480 is assumed to extend to a large extent in accordance with thermal expansion of the heat source 413. When the adhesive layer 480 extends to a large extent, the adhesive layer 480 is more likely to deteriorate than in the case where the adhesive layer 480 extends to a small extent.

Comparatively, as in the present exemplary embodiment where the multiple adhesive layers 480 are disposed with a gap G between each two of the adhesive layers 480, each of the adhesive layers 480 extends to a small extent, so that deterioration of the adhesive layers 480 is reduced.

Figure 9:
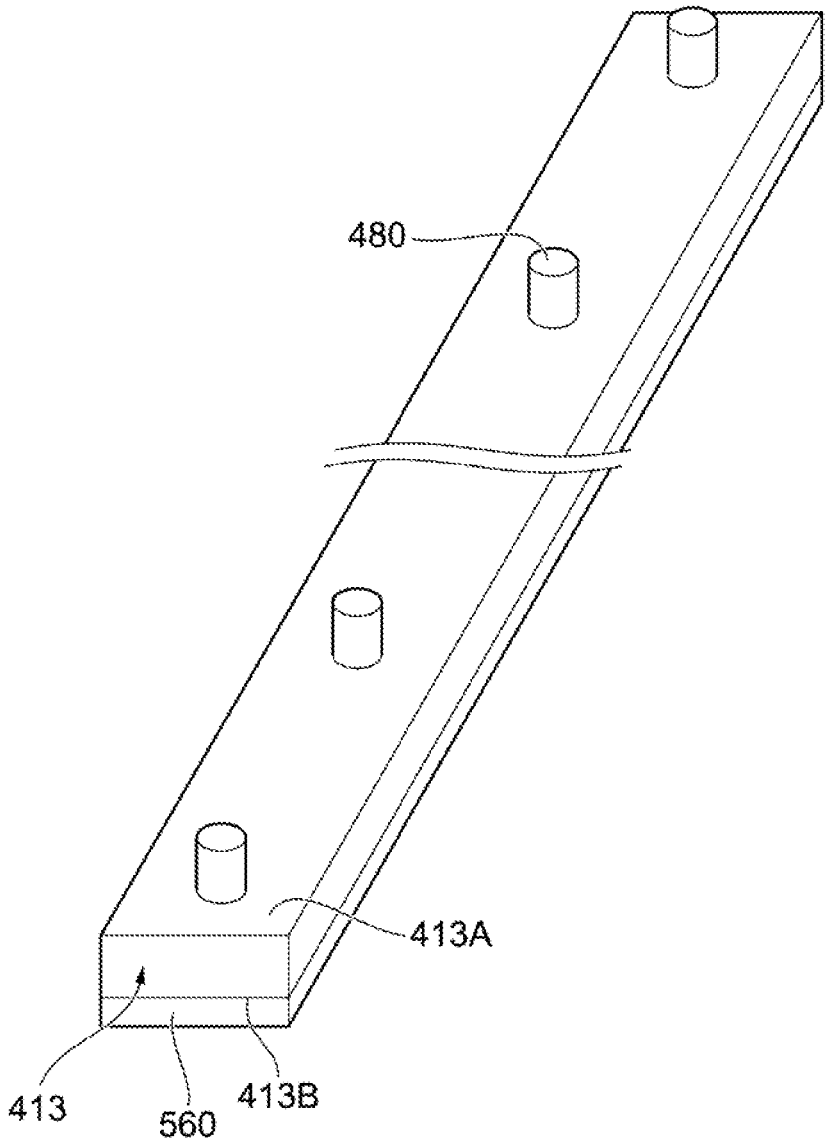
FIG. 9 illustrates another structure example of the fixing device.

FIG. 9 illustrates another structure example of the fixing device 40. FIG. 9 is a perspective view of the portion where the heat source 413, the adhesive layers 480, and the heat transfer member 560 are disposed.

In this structure example, as in the above case, the adhesive layers 480 are disposed between the opposing surface 413A of the heat source 413 and the support portion 441 (not illustrated in FIG. 9). In this structure example, the heat transfer member 560 is disposed on the back surface 413B of the heat source 413.

In the structure examples described above, the heat transfer member 560 is disposed on the opposing surface 413A of the heat source 413. In this case, the heat transfer member 560 is likely to have a smaller size to avoid interference with the adhesive layer 480 and the heat transfer member 560.

Comparatively, as in this structure example, the structure where the heat transfer member 560 is disposed on the back surface 413B dispenses with the through-holes 561 or the indentations 563.

In this case, the heat transfer member 560 is allowed to be disposed at a portion opposing the entirety of the back surface 413B of the heat source 413, and enables size increase.

Figure 10:
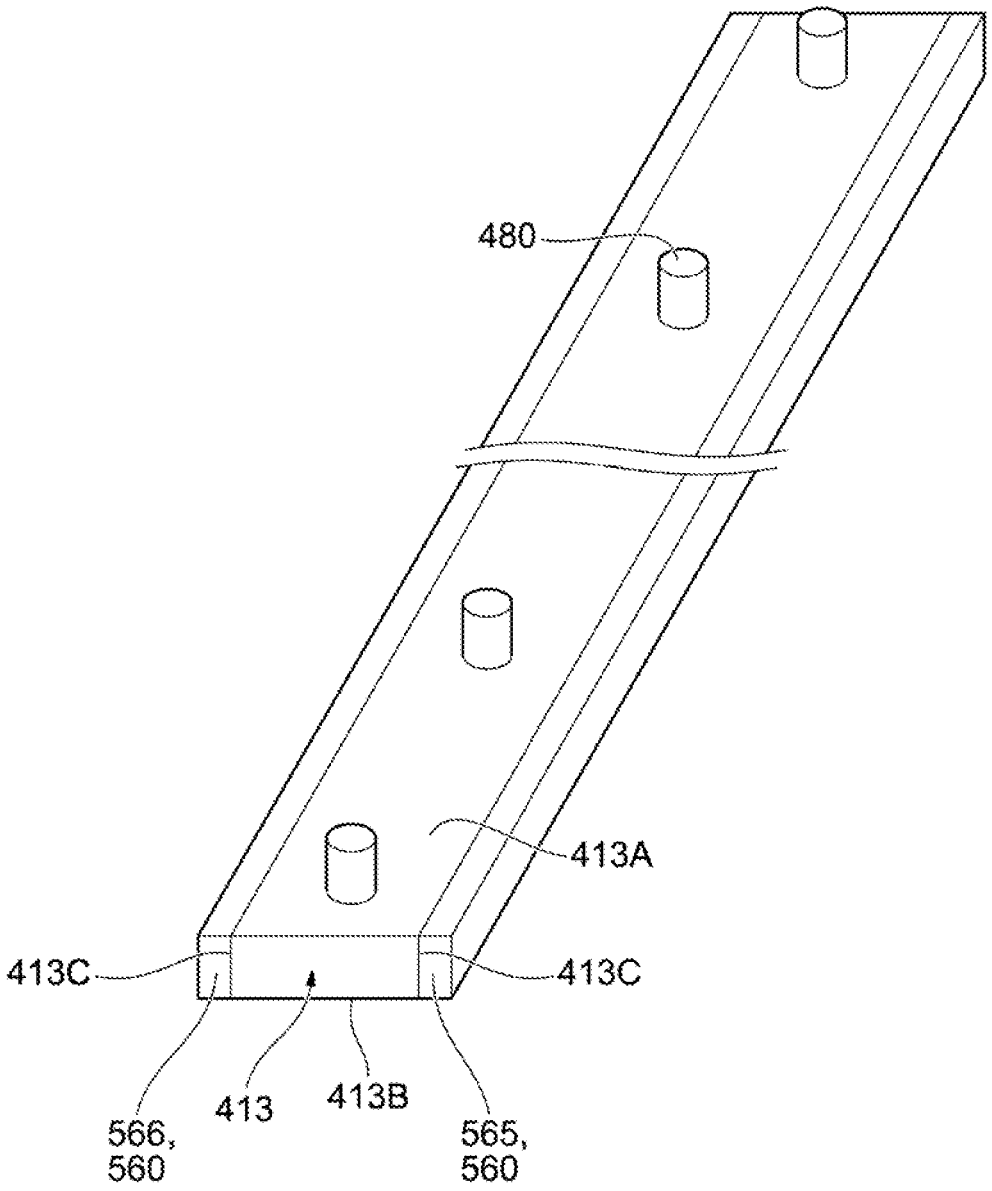
FIG. 10 illustrates another structure example of the fixing device.

FIG. 10 illustrates another structure example of the fixing device 40. FIG. 10 is also a perspective of a portion where the heat source 413, the adhesive layer 480, and the heat transfer member 560 are disposed.

In this structure example, as in the above case, the adhesive layers 480 are disposed between the opposing surface 413A of the heat source 413 and the support portion 441 (not illustrated in FIG. 10). In this structure example, the heat transfer member 560 is disposed at a portion opposing the side surface 413C of the heat source 413.

More specifically, in this structure example, the first heat transfer member 565 and the second heat transfer member 566 are disposed to serve as two heat transfer members 560.

The heat transfer members 560 are disposed at portions opposing two side surfaces 413C of the heat source 413.

Thus, the heat transfer members 560 may be disposed at portions opposing the side surfaces 413C, instead of the opposing surface 413A and the back surface 413B of the heat source 413.

Here, the case where two heat transfer members 560 are disposed has been described by way of example of the structure. However, the present disclosure may employ a structure where only one of the first heat transfer member 565 and the second heat transfer member 566 is disposed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device, comprising:

a heat source;

a support portion that supports the heat source;

at least one adhesive layer that fixes the heat source and the support portion to each other; and a heat transfer member through which heat of a portion of the heat source is transferred to another portion of the heat source, wherein the heat transfer member has at least one open portion extending through a thickness of the heat transfer member, the heat source and the support portion being fixed by the adhesive layer disposed in the open portion.

2. The fixing device according to claim 1, wherein the heat transfer member is disposed on a surface of the heat source on which the adhesive layer is disposed, and the at least one open portion of the heat transfer member includes at least one through-hole, and wherein the adhesive layer is disposed in the through-hole, and the heat source and the support portion are fixed to each other with the adhesive layer in the through-hole.

3. The fixing device according to claim 2, wherein the at least one through-hole includes a plurality of through-holes, and wherein the plurality of the through-holes are located at different positions in a longitudinal direction of the heat source.

4. The fixing device according to claim 1, wherein the heat transfer member is disposed on a surface of the heat source on which the adhesive layer is disposed, and the at least one open portion of the heat transfer member includes at least one indentation, and wherein the adhesive layer is disposed in the indentation, and the heat source and the support portion are fixed to each other with the adhesive layer in the indentation.

5. The fixing device according to claim 4, wherein the at least one indentation includes a plurality of indentations, and wherein the plurality of the indentations are located at different positions in a longitudinal direction of the heat source.

6. The fixing device according to claim 4, wherein the indentation is formed at an outer peripheral edge of the heat transfer member, and wherein neither through-holes nor indentations are disposed in a belt-shaped area of the heat transfer member extending in a longitudinal direction of the heat transfer member, the belt-shaped area being located at a center portion of the heat transfer member in a lateral direction of the heat transfer member.

7. The fixing device according to claim 1, wherein the heat transfer member is disposed on a surface of the heat source on which the adhesive layer is disposed, to extend from a first end portion to a second end portion in a longitudinal direction of the heat source, and to extend from the first end portion to the second end portion on a portion of the heat source other than a portion on which the adhesive layer is disposed.

8. The fixing device according to claim 7, wherein the heat transfer member is disposed to extend to the second end portion beside the adhesive layer.

9. The fixing device according to claim 1, wherein the heat source includes an opposing surface that opposes the support portion, and a back surface located opposite to the opposing surface, wherein the adhesive layer is disposed between the opposing surface of the heat source and the support portion, and wherein the heat transfer member is disposed on the back surface of the heat source.

10. The fixing device according to claim 1, wherein the heat source includes an opposing surface that opposes the support portion, a back surface located opposite to the opposing surface, and a side surface that connects the opposing surface and the back surface to each other, wherein the adhesive layer is disposed between the opposing surface of the heat source and the support portion, and wherein the heat transfer member is disposed at a portion opposing the side surface of the heat source.

11. The fixing device according to claim 1, wherein the adhesive layer is not in contact with the heat transfer member.

12. The fixing device according to claim 1, wherein the at least one adhesive layer includes a plurality of adhesive layers, and wherein a gap is disposed between each adjacent two of the plurality of adhesive layers.

13. The fixing device according to claim 12, wherein the plurality of adhesive layers are arranged unidirectionally.

14. The fixing device according to claim 1, wherein the heat source is disposed to extend unidirectionally, and wherein an end of the heat source in a lateral direction and the support portion are fixed to each other with the adhesive layer.

15. An image forming apparatus, comprising:

an image forming device that forms an image on a recording medium, and a fixing device that fixes the image formed on the recording medium by the image forming device onto the recording medium, wherein the fixing device includes the fixing device according to claim 1.

* * * * *